US011825953B1

(12) United States Patent
Kahn et al.

(10) Patent No.: US 11,825,953 B1
(45) **Date of Patent: *Nov. 28, 2023**

(54) MULTI-ZONE ADJUSTABLE BED WITH SMART ADJUSTMENT MECHANISM

(71) Applicants: Philippe Richard Kahn, Santa Cruz, CA (US); Arthur Kinsolving, Santa Cruz, CA (US); Mark Andrew Christensen, Santa Cruz, CA (US)

(72) Inventors: Philippe Richard Kahn, Santa Cruz, CA (US); Arthur Kinsolving, Santa Cruz, CA (US); Mark Andrew Christensen, Santa Cruz, CA (US)

(73) Assignee: DP Technologies, Inc., Scotts Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/651,890

(22) Filed: Feb. 21, 2022

Related U.S. Application Data

(63) Continuation of application No. 16/365,582, filed on Mar. 26, 2019, now Pat. No. 11,253,079.

(60) Provisional application No. 62/648,379, filed on Mar. 26, 2018.

(51) Int. Cl.

| | |
|---|---|
| ***A47C 27/08*** | (2006.01) |
| ***A47C 27/10*** | (2006.01) |
| ***A47C 31/00*** | (2006.01) |

(52) U.S. Cl.
CPC ..... *A47C 27/083* (2013.01); *A47C 27/082* (2013.01); *A47C 27/084* (2013.01); *A47C 27/10* (2013.01); *A47C 31/008* (2013.01)

(58) Field of Classification Search
CPC ... A47C 27/082; A47C 27/083; A47C 27/084; A47C 27/10; A47C 31/008
See application file for complete search history.

(56) References Cited

U.S. PATENT DOCUMENTS

| | | | | |
|---|---|---|---|---|
| 4,688,283 | A | 8/1987 | Jacobson et al. | |
| 5,265,296 | A | 11/1993 | Abbas et al. | |
| 5,873,137 | A * | 2/1999 | Yavets-Chen | A61G 7/05776 5/713 |
| 8,418,296 | B1 | 4/2013 | Hanlon et al. | |
| 8,844,079 | B2 * | 9/2014 | Skinner | A61G 7/05776 5/713 |
| 8,917,166 | B2 | 12/2014 | Collins, Jr. et al. | |
| 8,973,186 | B2 | 3/2015 | Bhai | |
| 9,295,600 | B2 * | 3/2016 | Receveur | G16Z 99/00 |
| 9,707,141 | B2 | 7/2017 | Bobey et al. | |

(Continued)

OTHER PUBLICATIONS

Advisory Action Office Action, U.S. Appl. No. 16/365,582, dated Mar. 8, 2021, 5 pages.

(Continued)

*Primary Examiner* — David R Hare
*Assistant Examiner* — George Sun
(74) *Attorney, Agent, or Firm* — Nicholson De Vos Webster & Elliott LLP; Judith Szepesi

(57) ABSTRACT

A smart sleep system comprising a mattress including a plurality of pressure zones, each pressure zone separately adjustable for firmness, a sensor to sense a user's position on the mattress, a processing system to determine pressure for each of the plurality of pressure zones based on data from the sensor, and a controller to adjust one or more of the pressure zones based on the determination.

21 Claims, 13 Drawing Sheets

(56) References Cited

U.S. PATENT DOCUMENTS

| | | | | |
|---|---|---|---|---|
| 9,763,576 | B2 | 9/2017 | Ribble | |
| 10,016,325 | B2 | 7/2018 | Ribble et al. | |
| 10,314,407 | B1 * | 6/2019 | Main | A61B 5/1036 |
| 11,013,338 | B2 * | 5/2021 | Youngblood | F25D 29/00 |
| 2002/0124314 | A1 | 9/2002 | Chang | |
| 2003/0221261 | A1 * | 12/2003 | Torbet | A47C 27/082 5/709 |
| 2010/0318239 | A1 * | 12/2010 | Oexman | A47C 23/0435 5/709 |
| 2011/0289691 | A1 * | 12/2011 | Lafleche | A47C 27/10 5/713 |
| 2013/0117936 | A1 | 5/2013 | Stryker et al. | |
| 2013/0145558 | A1 * | 6/2013 | Bhai | A61G 7/05 5/710 |
| 2013/0309713 | A1 * | 11/2013 | Ribble | A61B 5/6892 435/34 |
| 2014/0259406 | A1 * | 9/2014 | Ead | A47C 21/028 5/488 |
| 2014/0277778 | A1 | 9/2014 | Nunn et al. | |
| 2015/0082547 | A1 * | 3/2015 | Boyd | G05D 16/2006 5/706 |
| 2015/0128353 | A1 * | 5/2015 | Kildey | A61B 5/02055 600/595 |
| 2015/0289666 | A1 * | 10/2015 | Chandler | A47C 27/082 5/423 |
| 2016/0015184 | A1 * | 1/2016 | Nunn | A47C 27/082 700/282 |
| 2016/0058641 | A1 * | 3/2016 | Moutafis | A61G 7/05776 5/672 |
| 2016/0242561 | A1 * | 8/2016 | Riley | A47C 27/083 |
| 2016/0242562 | A1 * | 8/2016 | Karschnik | A47C 27/082 |
| 2016/0345571 | A1 | 12/2016 | Van Doornewaard | |
| 2016/0367039 | A1 | 12/2016 | Young et al. | |
| 2017/0202366 | A1 | 7/2017 | Mackey | |
| 2017/0318981 | A1 * | 11/2017 | Duwell | A47C 27/082 |
| 2018/0027988 | A1 * | 2/2018 | Poodeh | G06N 20/20 |
| 2018/0064594 | A1 * | 3/2018 | Finch, Jr. | A61G 7/05 |
| 2018/0110341 | A1 * | 4/2018 | Reynolds | A47C 21/044 |
| 2018/0116420 | A1 | 5/2018 | Shakal | |
| 2018/0140106 | A1 * | 5/2018 | Kaufman | A47C 27/082 |
| 2019/0209806 | A1 * | 7/2019 | Allen | G16H 40/67 |

OTHER PUBLICATIONS

Advisory Action, U.S. Appl. No. 16/365,582, dated Oct. 29, 2021, 3 pages.
Final Office Action, U.S. Appl. No. 16/365,582, dated Aug. 17, 2021, 29 pages.
Final Office Action, U.S. Appl. No. 16/365,582, dated Dec. 16, 2020, 16 pages.
Non Final Office Action, U.S. Appl. No. 16/365,582, dated Aug. 14, 2020, 15 pages.
Non-Final Office Action, U.S. Appl. No. 16/365,582, dated Apr. 21, 2021, 25 pages.
Notice of Allowance, U.S. Appl. No. 16/365,582, dated Dec. 27, 2021, 14 pages.

* cited by examiner

MULTI-ZONE ADJUSTABLE BED WITH SMART ADJUSTMENT MECHANISM

RELATED APPLICATIONS

The present application is a continuation of U.S. patent application Ser. No. 16/365,582, filed Mar. 26, 2019, issuing as U.S. Pat. No. 11,253,079 on Feb. 22, 2022, which application claims priority to U.S. Provisional Patent Application No. 62/648,379, filed on Mar. 26, 2018, all which are incorporated herein by reference in their entirety.

FIELD

The present invention relates to sleep, and more particularly to a smart adjustment mechanism for beds.

BACKGROUND

Mattresses often are not the appropriate firmness for users. For example, a mattress may be too soft, or too hard.

One prior art sleep system attempting to address this problem utilizes a mattress with a plurality of zones, where each zone can be configured for firmness. The configuration in the prior art systems was based on a user controlling the device. In other systems, a medical professional controlled the firmness of the portions of the mattress. However, such systems require manual control.

BRIEF DESCRIPTION OF THE FIGURES

The present invention is illustrated by way of example, and not by way of limitation, in the figures of the accompanying drawings and in which like reference numerals refer to similar elements and in which.

DETAILED DESCRIPTION

A smart adjustable sleep system is described. People change sleeping position multiple times throughout the night. The pressure map for each position should be set for so the bed configuration does not have any negative effects on sleep quality. The present application utilizes sensors to determine the user's sleep position, and optionally the user's sleep state, environment, and other factors. Utilizing this data, the pressure map for the mattress is adjusted for optimal sleep.

Figure 1A:
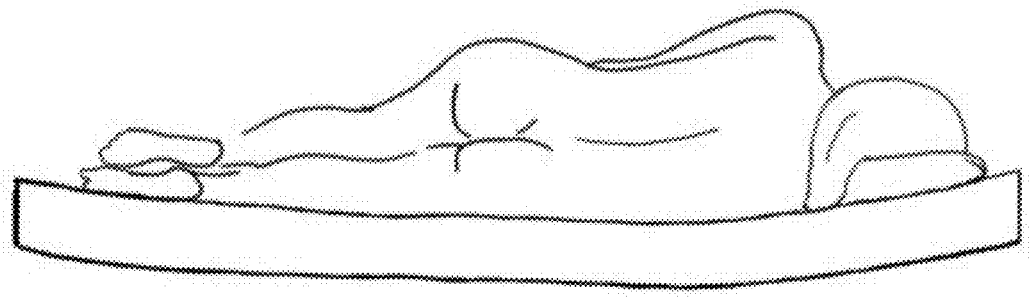
FIG. 1A illustrates the effect of a too soft mattress on the body of a side sleeper.
Figure 1B:
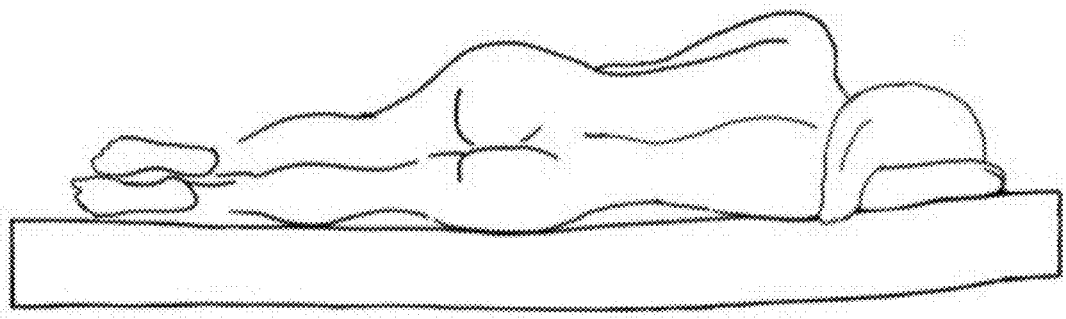
FIG. 1B illustrates the effect of a too hard mattress on the body of a side sleeper.

As shown in FIG. 1A, a too soft mattress causes the spine to curve. This will cause spinal problems over time and also may impact sleep quality. While only a side-sleeping position is shown, a too soft mattress will similarly deform for someone sleeping in a different position. FIG. 1B shows a too hard mattress, which shows that the back and shoulders are out of alignment, when sleeping on the side. Neither the soft mattress nor the hard mattress follows the ergonomic lines of the body.

Figure 1C:
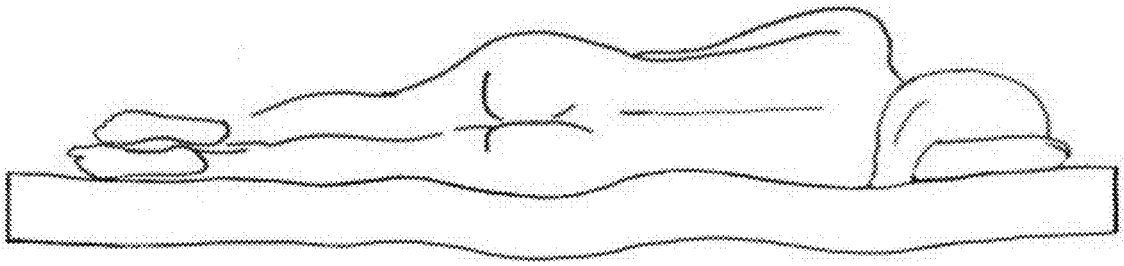
FIG. 1C illustrates the ideal mattress configuration for a side sleeper.

FIG. 1C illustrates the perfect mattress, in which the side sleeper's spine is straight, and there are no pressure points out of alignment. These pressure points are different for different sleep positions, and different for a user based on their height, weight, body configuration, etc. The present system automatically adjusts to various possible sleep positions, by using sensors and multiple adjustable zones. Humans naturally change positions while they are sleeping, often every hour or even more frequently, because in most beds every sleep position puts pressure on some body parts. By providing a smart system that adjusts the mattress to all body configurations, the system can dynamically minimize the pressure points. This may lead to more restful sleep, as the sleeper need not seek different positions to adjust to discomfort from pressure points. In one embodiment, the system includes two or more zones s to adapt as close to the ideal shape for the particular sleeper in that particular position as possible. The adjustment is dynamic and corrected throughout the night, taking account changes in position as the sleeper moves around. In one embodiment, the system dynamically identifies the pressure points for the particular individual, based on their personal characteristics and sensor data. Additionally, medical conditions, illnesses, injuries, and other temporary characteristics may change the pressure points/needs of the sleeper. In one embodiment, each zone is controlled by one or more pneumatic pumps, to adjust the firmness of the zone. Alternative ways of controlling each of the zones may be used.

The following detailed description of embodiments of the invention makes reference to the accompanying drawings in which like references indicate similar elements, showing by way of illustration specific embodiments of practicing the invention. Description of these embodiments is in sufficient detail to enable those skilled in the art to practice the invention. One skilled in the art understands that other embodiments may be utilized and that logical, mechanical, electrical, functional and other changes may be made without departing from the scope of the present invention. The following detailed description is, therefore, not to be taken in a limiting sense, and the scope of the present invention is defined only by the appended claims.

Figure 2A:
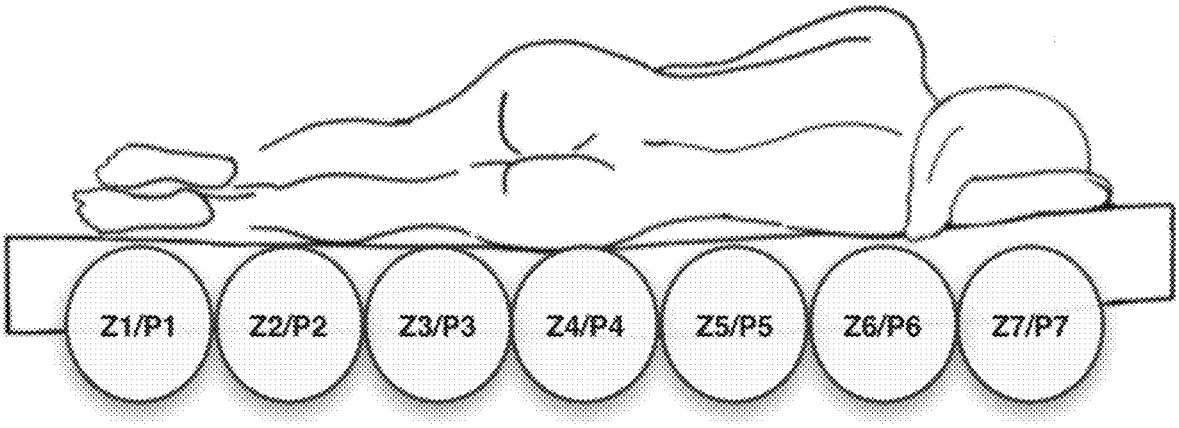
FIG. 2A illustrates a pre-adjustment adjustable multi-zone bed, showing the separate zones of adjustment.

FIG. 2A illustrates a pre-adjustment adjustable multi-zone bed, showing the separate zones of adjustment. The mattress shown is too hard, and it can be seen that the sleeper's spine is misaligned. But the system shows seven zones, Z1 through Z7 for the seven pressure points P1 through P7.

Figure 2B:
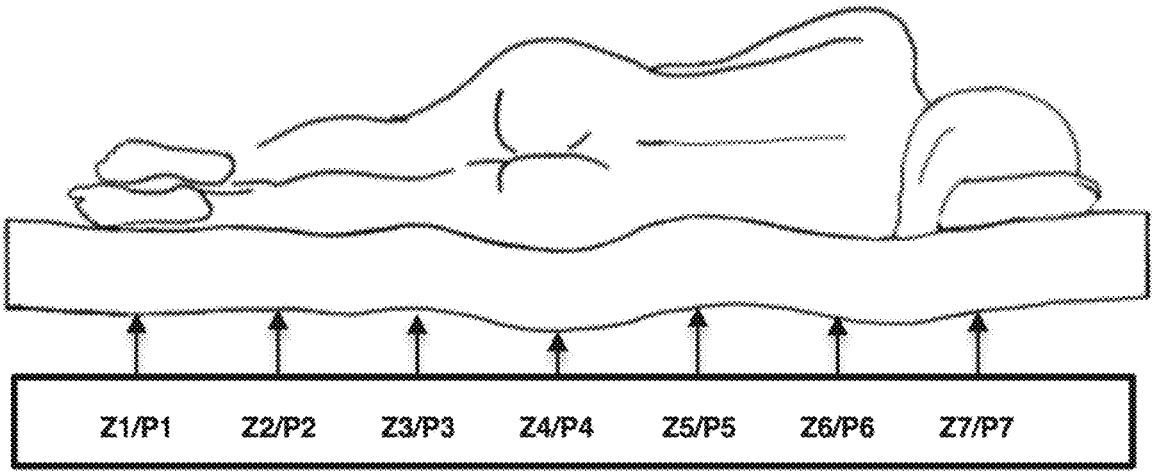
FIG. 2B illustrates the adjusted multi-zone bed, showing the effect on the spine of a side sleeper.

FIG. 2B illustrates the adjusted multi-zone bed, showing the effect on the spine of a side sleeper. As can be seen, the spine of the sleeper is aligned straight, with the bed supporting the head, torso, waist, hips, and legs appropriately. When the user shifts in sleep, the zones also adjust, so there is proper support regardless of the user's position. In fact, the bed is able to adjust to any sleep position including unusual positions. The typical sleep positions are considered back, stomach, and side sleeping. However, the actual sleep positions of users vary significantly between these basic positions. The present system is designed to address various sleep positions. In one embodiment, the system further addresses the unique characteristics of the user including temporary characteristics, such as injuries, that would change the user's sleep position and requirements. By evaluating the user data, and obtaining continuously updated information, the system can adjust to the user.

Figure 3A:
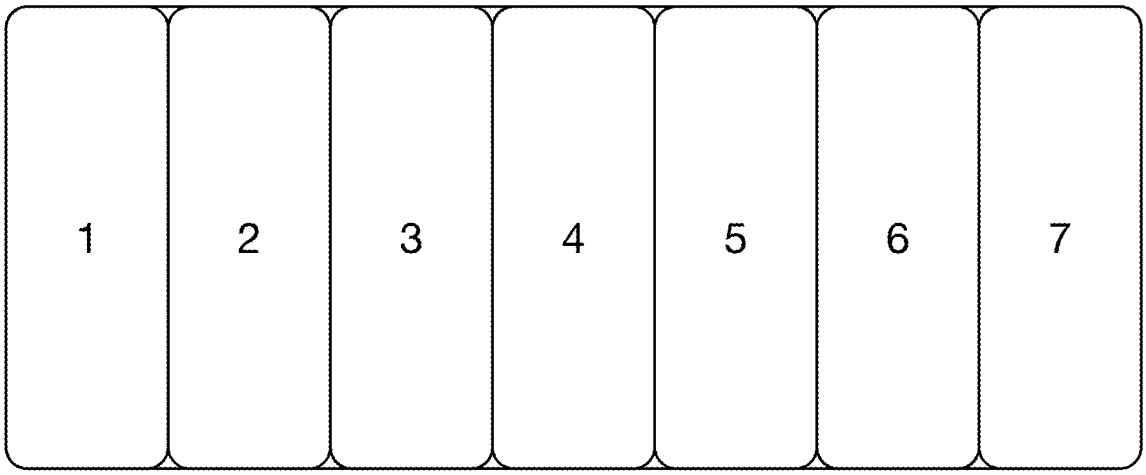
FIGS. 3A-3G illustrate embodiments of zone configurations that may be used.
Figure 3B:
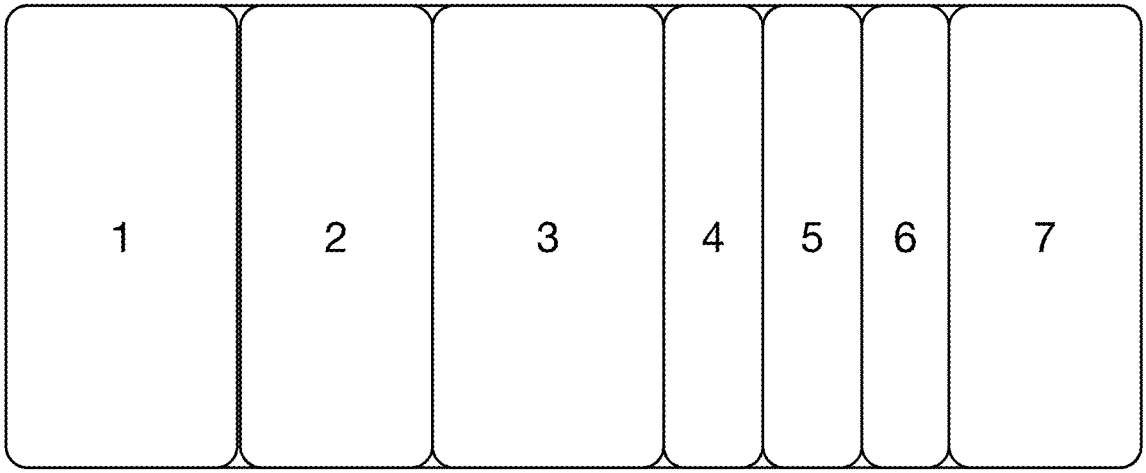

FIGS. 3A-3G illustrate embodiments of zone configurations that may be used. In one embodiment, the system includes seven evenly distributed zones, as shown in FIG. 3A. Each zone corresponds to a typical pressure point for a sleeper laying horizontally on the bed, e.g. ankles, calves, thighs, hips, torso, shoulders, head. FIG. 3B illustrates one embodiment of the seven zones unevenly distributed. In one embodiment, the uneven distribution is designed to be closer to the proportions of the body corresponding to the pressure points for an average person. In one embodiment, the system may provide a variety of potential configurations, based user characteristics. For example, in one embodiment, a tall user may select a different configuration than a short user. In one embodiment, the user proportions may dictate the configuration, e.g. the inseam to torso to height ratios, and overall height in combination would be used to create a customized configuration.

Figure 3C:
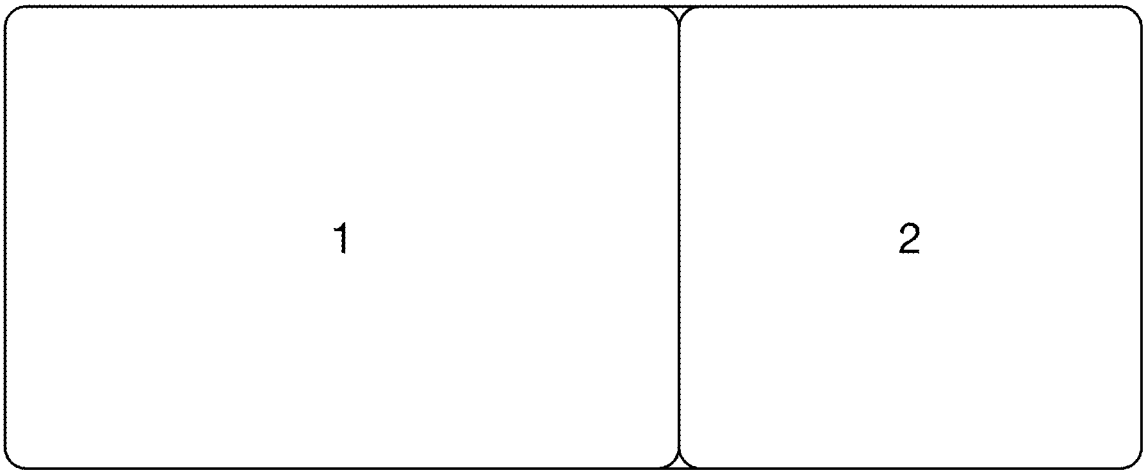
Figure 3D:
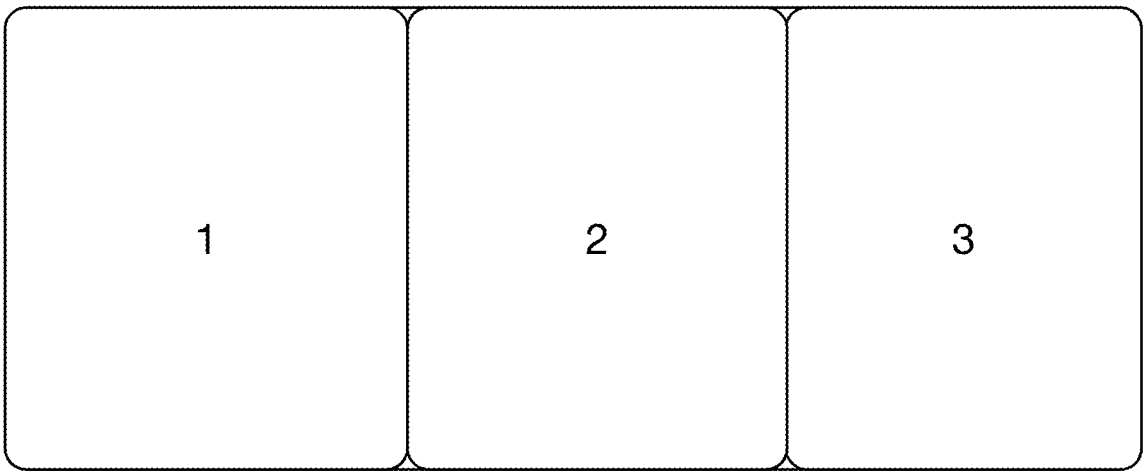

FIG. 3C illustrates one embodiment of the minimal configuration in which there are two zones. FIG. 3D illustrates another embodiment in which there are three zones.

Figure 3E:
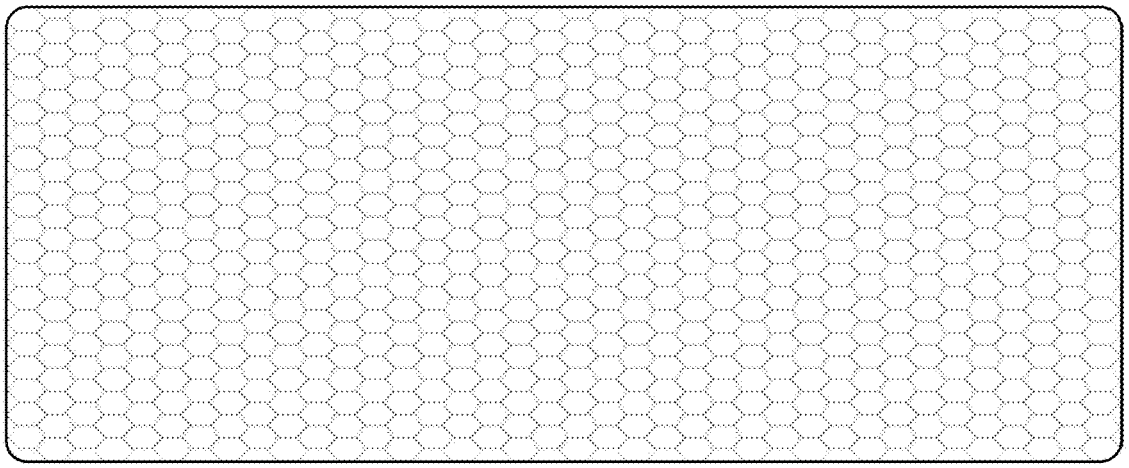
Figure 3F:
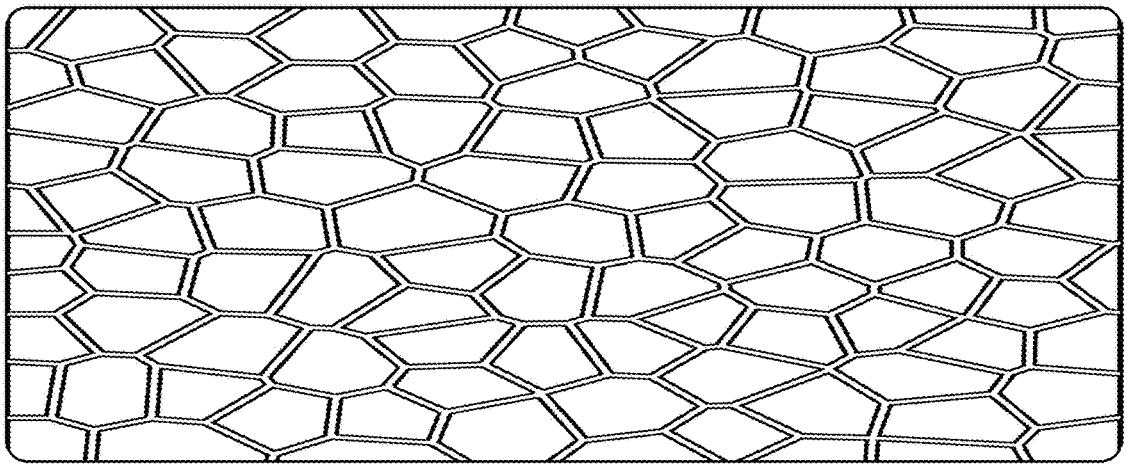
Figure 3G:
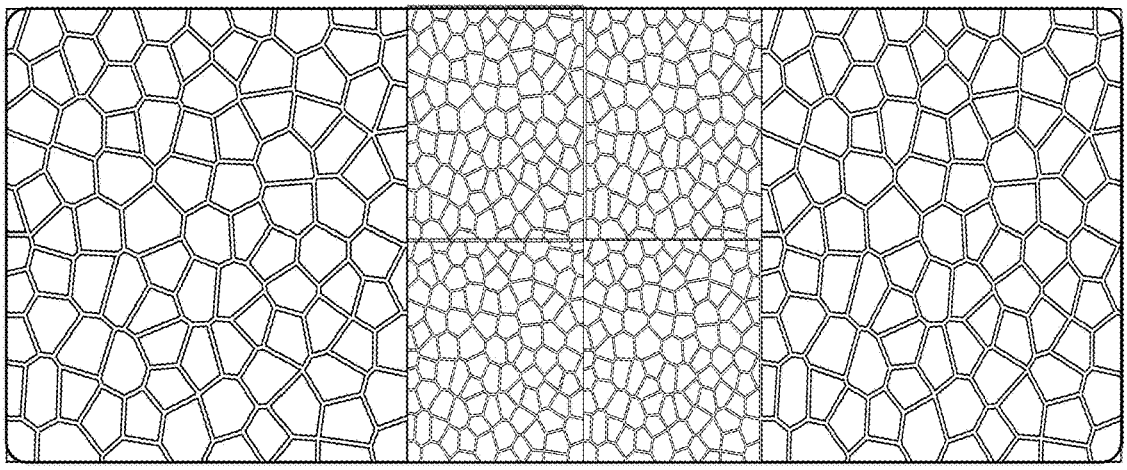

FIG. 3E illustrates another embodiment, in which there are a large number of zones, which are arranged in this example in a hexagonal pattern. This configuration is merely exemplary and the shape of the individual zones may vary. In one embodiment, as shown in FIG. 3E, the shapes may be identical in size. FIG. 3F illustrates another embodiment with a larger number of zones in which the individual zones are of varying sizes. In one embodiment, the varying sizes may vary based on the number of pressure points, and likelihood of needing adjustment in each location. For example, as a general rule the user's legs below the knee are not as sensitive to variations as the user's spine. Therefore, the area of the spine may have more zones than the area below the knee. FIG. 3G illustrates that the irregular pattern may further have sub-areas in which the density of zones is different. In this example, the density of zones around the user's hips and waist are higher, because that is generally an area where there is more variation between users, and also between pressure points in the various sleep positions.

Figure 3H:
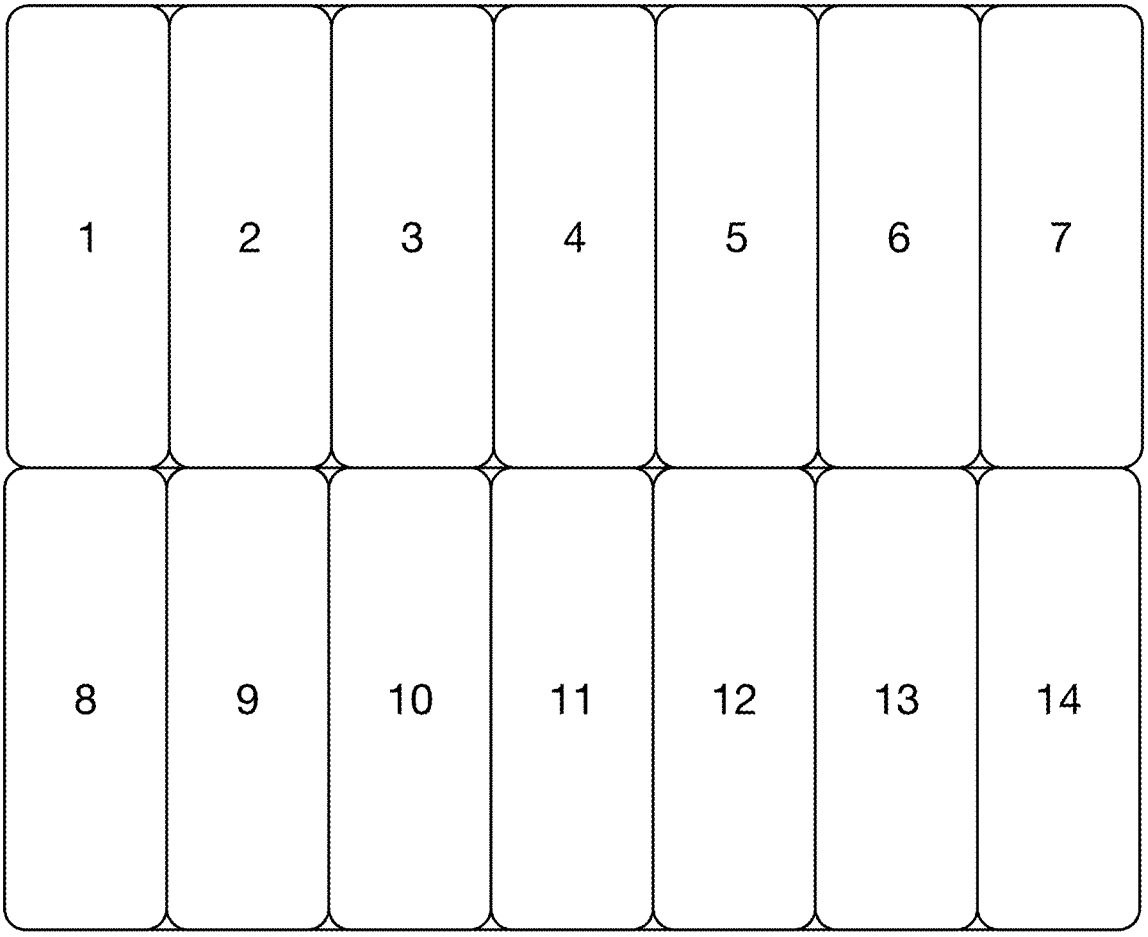
FIG. 3H illustrates one embodiment of the zone configuration for two sleepers.

FIG. 3H illustrates an exemplary set of zones for a bed designed for two sleepers. In this example, there are fourteen zones, seven for each sleeper. In one embodiment, each sleeper's zones are separately evaluated. In one embodiment, if one sleeper moves onto the zone for the other sleeper, the system may evaluate the combined sleepers' positions to set an optimal firmness configuration.

Of course, the number of zones and distribution of zones shown in FIGS. 3A-3H are merely exemplary. The number of zones may vary from a minimum of two up to one thousand zones, or potentially more. The configuration of the zones may also vary from hexagons, rectangles, irregular shapes to triangles, circles, or any other shape may be used.

Figure 4:
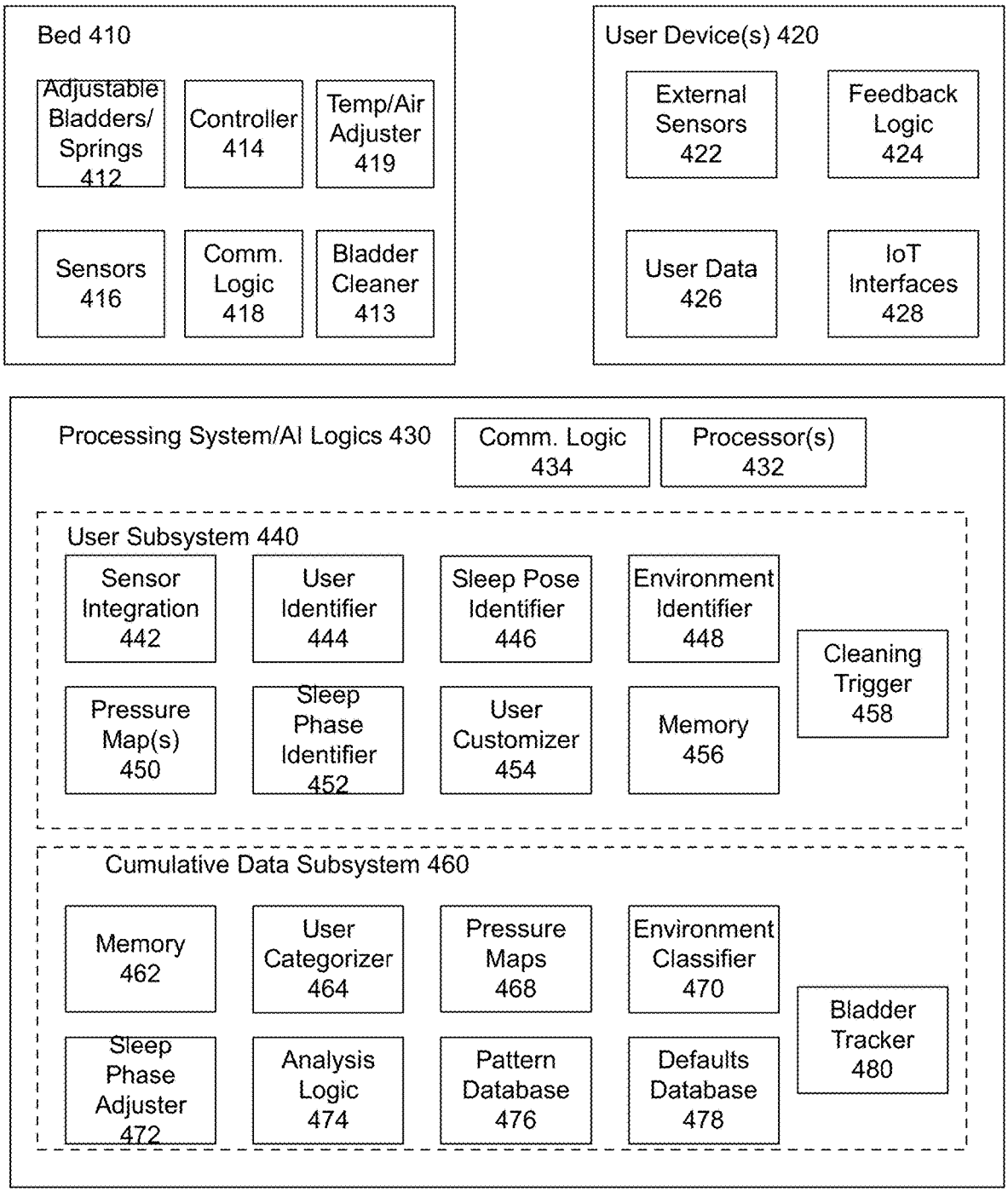
FIG. 4 is a block diagram of one embodiment of the system.

FIG. 4 is a block diagram of one embodiment of the system. The bed 410 includes adjustable air bladders, water compartments, springs, or other elements 412 which may be adjusted in firmness. Controller 414 controls the firmness of the adjustable elements 412. In one embodiment, controller 414 may also control other aspects of the bed 410, such as temperature and airflow adjustment, based on adjuster 419.

The bed includes sensors 416 to obtain user position data which may be used by the processing system 430 to determine the user's sleep position, sleep phase, and other health data about the user, such as heart rate, respiration rate, snoring, etc. In one embodiment, the sensors 416 are embedded into the mattress and/or bedframe. The sensors 416 in one embodiment include motion sensors which detect movement on the mattress. In one embodiment, the sensors 416 include one or more accelerometers. In one embodiment, the sensors 416 include one or more inductive sensors. The sensors in one embodiment include two or more motion sensors. The sensors in one embodiment include one or more cameras. In one embodiment, the sensors 416 may include pressure sensors. In one embodiment, the pressure sensors may be built into the adjustable elements 412 of the mattress. In one embodiment, the sensors 416 may be sensors embedded in slats or other support structure underneath the mattress. In one embodiment, the sensors 416 may be passive sensors located in the bedframe. In one embodiment, the passive sensors may be placed adjacent to the bed. In one embodiment, the sensors 416 may further include temperature sensors, and additional sensors that may be useful to monitor the user's sleep. In one embodiment, a combination of the above described sensors may be used.

The bed 410 in one embodiment includes a bladder cleaner 413, when the bed is controlled using air bladders. The bladder cleaner 413 utilizes heated hair to dry out the adjustable bladders. Over time, the air bladders can grow bacteria, especially in humid environments. In one embodiment, the sensors 416 include at least one sensor to determine the condition of the bladders. The sensor data is then used by the processing system 430 to determine whether a cleaning should be triggered. If so, the cleaning trigger 458 triggers the bladder cleaner 413. The bladder cleaner 413 uses heated and/or cooled air to clean the bladder. In one embodiment, airflow may be used, without a temperature adjustment. In one embodiment, the bladder cleaner 413 additionally uses ultraviolet light. In one embodiment, the bladder cleaner 413 uses a cleaning solution. In one embodiment, the cleaning solution may be hydrogen peroxide. In one embodiment, the cleaning solution may be bleach. In one embodiment, the cleaning solution may be a refillable liquid. In one embodiment, the bladder cleaner 413 may use a gas to clean the bladders. In one embodiment, ozone may be used.

The bed 410 communicates with other elements via communication logic 418. In one embodiment, the bed 410 communicates with a user device 420, such as a smart phone. In one embodiment, the bed communicates with a base station. The base station may communicate with user device(s) 420 or directly with processing system/AI logics 430. The bed 410 may be a mattress, a bedframe and mattress, or a bedframe including the described elements.

The user device(s) 420 may include external sensors 422. The external sensors may include accelerometers or other motion sensors built into a mobile device. In one embodiment, the user device(s) 420 may include a user wearable device including one or more motion/acceleration sensors. The external sensors 422 may also include temperature sensors, air quality sensors, barometric pressure sensors, and/or other sensors.

In one embodiment, the user device(s) 420 may interface with or be part of Internet of Things (I) devices within the user's household that include sensors. For example, sound sensors built into a digital assistant or similar device would be considered external sensors 422. In one embodiment, the user device(s) collect the user data 426 from bed 410. In one embodiment, the user data 426 is stored in a buffer and/or memory. In one embodiment, the bed 410 utilizes the user device(s) 420 to send the user data to the processing system/AI logics 430 which may be a remote or cloud-based system.

In one embodiment, the user device(s) 420 may provide a feedback logic 424. The feedback logic 424 enables the user to see how the bed 410 performed, and the quality of their sleep, as evaluated by the processing system/AI logics 430. In one embodiment, the feedback logic 430 further allows the user to provide personal feedback about their sleep after a sleep session. Such feedback may be used to adjust the bed 410 in subsequent sleep sessions.

The user device(s) 420 may further include IoT device interfaces 428. These interfaces enable the system to connect to the household network. In one embodiment, this may be used to control the user's environment. In general, the environment impacts the user's quality of sleep. It may also impact the appropriate pressure points. Additionally, having sleep data about the user is useful to the IoT devices.

Processing system/AI logics 430 in one embodiment, comprises one or more processors 432 which are used to process the data from the bed 410 and optionally user device(s) 420. The processing system/AI logics 430 includes a communication logic 434 which receives data from the bed 410 and/or user device(s) 420. In one embodiment, the processing system/AI logics 430 may be implemented in the Cloud, that is as distributed processing. In another embodiment, the processing system/AI logics 430 may be implemented on one or more server systems. In one embodiment, the user subsystem 440 may be implemented on the user's own device, while the cumulative data subsystem 460 may be in the cloud, collecting processed data from the user subsystem 440. In one embodiment, a base station including a processor may be part of the processing system 430.

User subsystem 440 includes a sensor integration system 442. The sensor integration system 442 integrates sensor data from the various sources, including the one or more sensors 416 in the bed 410, the one or more sensors 422 in the external devices 420. In one embodiment, the integration ensures that the data from all sensors can be utilized together, for more complete data. As noted above, sensor sets may include sensors in the bed, on the bed, around the bed, worn by the user, integrated into various Internet of Things devices, etc.

The user identifier 444 identifies the user, and the user's category. The user's category generally describes the user characteristics. For example, a category may be: between 5 '8" and 5'10", male, athletic, side sleeper, recent knee surgery. In one embodiment, these user characteristics are provided by the user. In one embodiment the user is prompted at set-up to provide their characteristic data, e.g. age, height, weight, body shape, athletic level, sleep position (s), etc. In one embodiment, the user is also prompted to update the system with any temporary characteristics, such as knee surgery, illness, etc. In one embodiment, if the system detects a significant change in the user's sleep position or pattern, the system may prompt the user to indicate whether something has changed, e.g. whether the user has a new condition for which the system may be able to adjust.

The set of user characteristics collected from many users is used by the cumulative data subsystem to evaluate the best settings for each user. In one embodiment, the categories become narrower as the available data set increases. For example, initially the categories may just be as above. But once there is data from millions of users, a user's category may be: 5'9", male, 160 pounds, athletic build, swimmer, side sleeper with legs at 20 degrees, recent knee surgery. The added specificity increases the likelihood that the selected pressure pattern will match the user's ideal pattern.

Sleep pose identifier 446 identifies the users sleep position. The sleep pose identifier 446 utilizes the sensor data to determine exactly how the user is positioned on the bed. The system uses the sensor data to identify a sleep position. In one embodiment, the sensor data, integrated by data integrator 442, is used to identify the position of the head, torso, and legs, as well as the relative angles of the body parts with respect to the bed and each other. Instead of merely identifying the sleep position as on the front/back/side, in one embodiment, the present system identifies thousands of different sleep positions. For example, a user who sleeps on their side with their arm above their head has a different set of pressure points than the user who sleeps on their side with their arm used to cushion their head. Similarly, a user who sleeps on their side curled into a C shape has a different set of pressure points, and locations for those pressure points than a user who sleeps on their side with straight back and legs. By using sensors to identify the specific sleep position, rather than defining only a few default positions, the system can optimize the pressure zones for the real-world configuration of the user's body rather than an idealized set of potential configurations.

Pressure maps 450 determine the pressure points for the user, based on the user data and the sleep position data. In one embodiment, sleep phase identifier 452 determines the user's sleep phase based on the sensor data. The user's sleep phase may be relevant to determine the ideal configuration for the bed 410.

In one embodiment, the environment identifier 448 identifies the current environmental conditions for the user. Environmental conditions may include light levels, air quality, and other environmental factors which may impact the user's sleep. User customer 454 determines the preferred configuration for the bed based on this data and sends the control signals to the adjustable bladders/springs 412 in the bed. In one embodiment, this is done via communication logic 434.

In one embodiment, in addition to monitoring the user's sleep phases and restfulness, the system may also receive data from the user via feedback logic 424. This may be used to further optimize the bed configuration, based on what works and does not work for this particular user.

In one embodiment, in addition to customizing the bed 410 for a particular user, the system uses a cumulative data subsystem 460 to collect data from a large group of users and utilize machine learning/AI logics 430. This data is used for providing a baseline configuration, based on initial user data, as well as evaluating what factors impact the user's sleep quality and quantity. In one embodiment, anonym ized data is collected to identify categories of users 464, pressure maps 468, environments 470, sleep phases 472. In one embodiment, the analysis logic 474 utilizes all of this data to generate a set of patterns stored in a pattern database 476. In one embodiment, the patterns may include patterns of changes of position, as determined based on data collected from a large number of users. In one embodiment, the cumulative data subsystem 460 is used to create a defaults database 478. The defaults database 478, in one embodiment, provides the default configurations for users initially.

In one embodiment, the cumulative data subsystem 460 further includes a bladder tracker 480 which tracks the cleaning patterns for the bladders. In one embodiment, the cleaning pattern is also associated with the environmental data. In one embodiment, this may create a default timing for cleaning. In one embodiment, this may also be used to enable cleaning of bladders when no sensor data indicating the bladder status is available.

Figure 5:
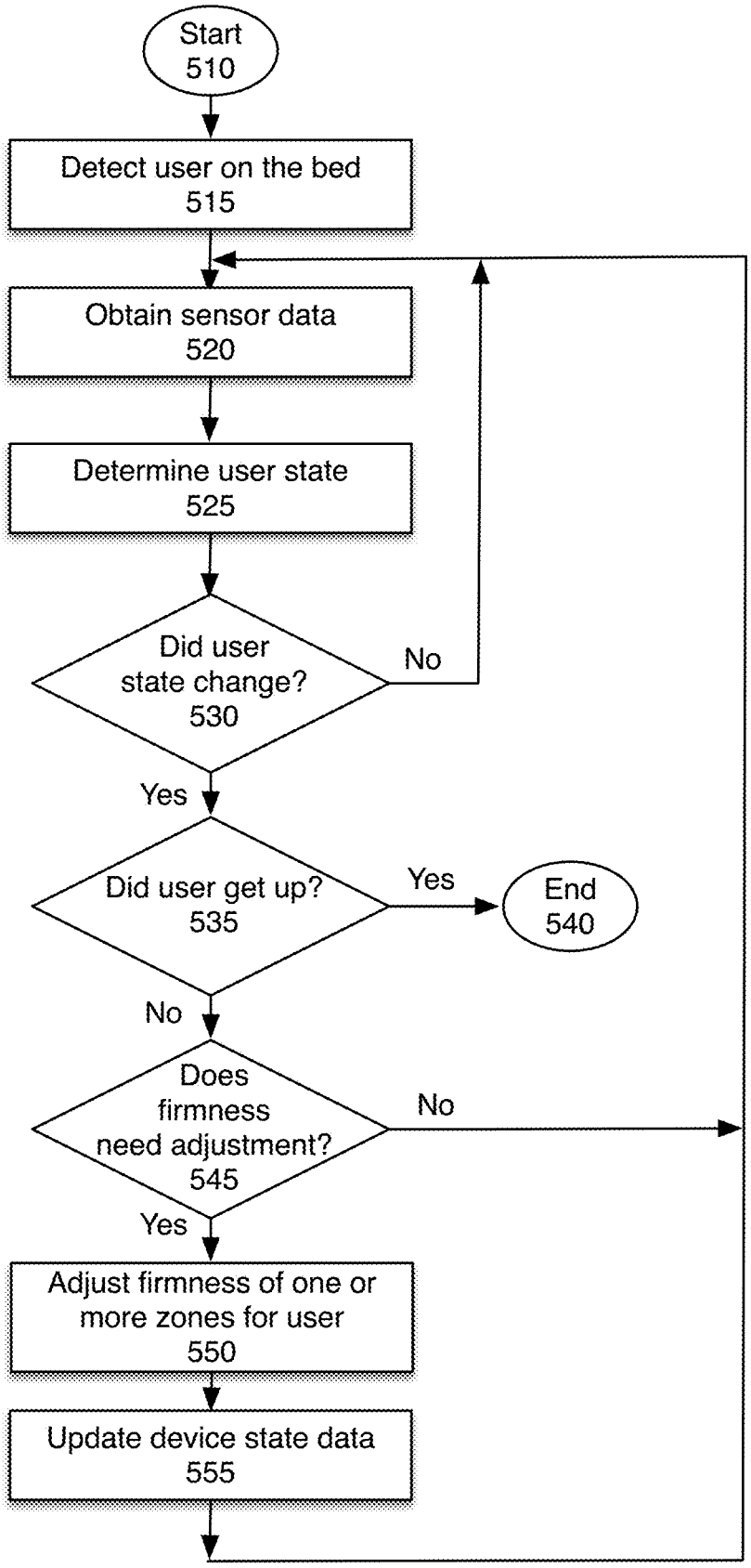
FIG. 5 is a flowchart of one embodiment of using the system.

FIG. 5 is a flowchart of one embodiment of using the system. The process starts at block 510. At block 515 the sensors detect a user on the bed. In one embodiment, the sensors may be in a low power mode until a user is detected.

At block 520 sensor data is obtained. The sensor data may be raw data, or pre-processed data. At block 530, the sensor data is used to determine the user's state. The user's state may be awake or asleep, laying on back or side or front or in another configuration.

At block 530 the process determines whether the user's state has changed. If the user's state has not changed, the process returns to block 520 to continue obtaining sensor data. If the user's state changed, the process continues to block 535. At block 535, the process determines whether the user got up. If so, the process ends. Otherwise, the process continues to block 55.

At block 545, the process determines whether the firmness of one or more of the zones should be adjusted based on the change in the user's states. If no adjustment is needed, the process returns to block 520 to continue monitoring the sensor data. In one embodiment, the adjustment may include, in addition to firmness, temperature and height. If adjustment is needed at block 550 the firmness or other aspects of one or more zones is adjusted. At block 555 the device state data is updated, to keep track of the device configuration. In one embodiment, the configuration data may be mapped to the feedback data and other sensor data to construct a timeline. The process then returns to block 520 to continue obtaining sensor data.

Figure 6:
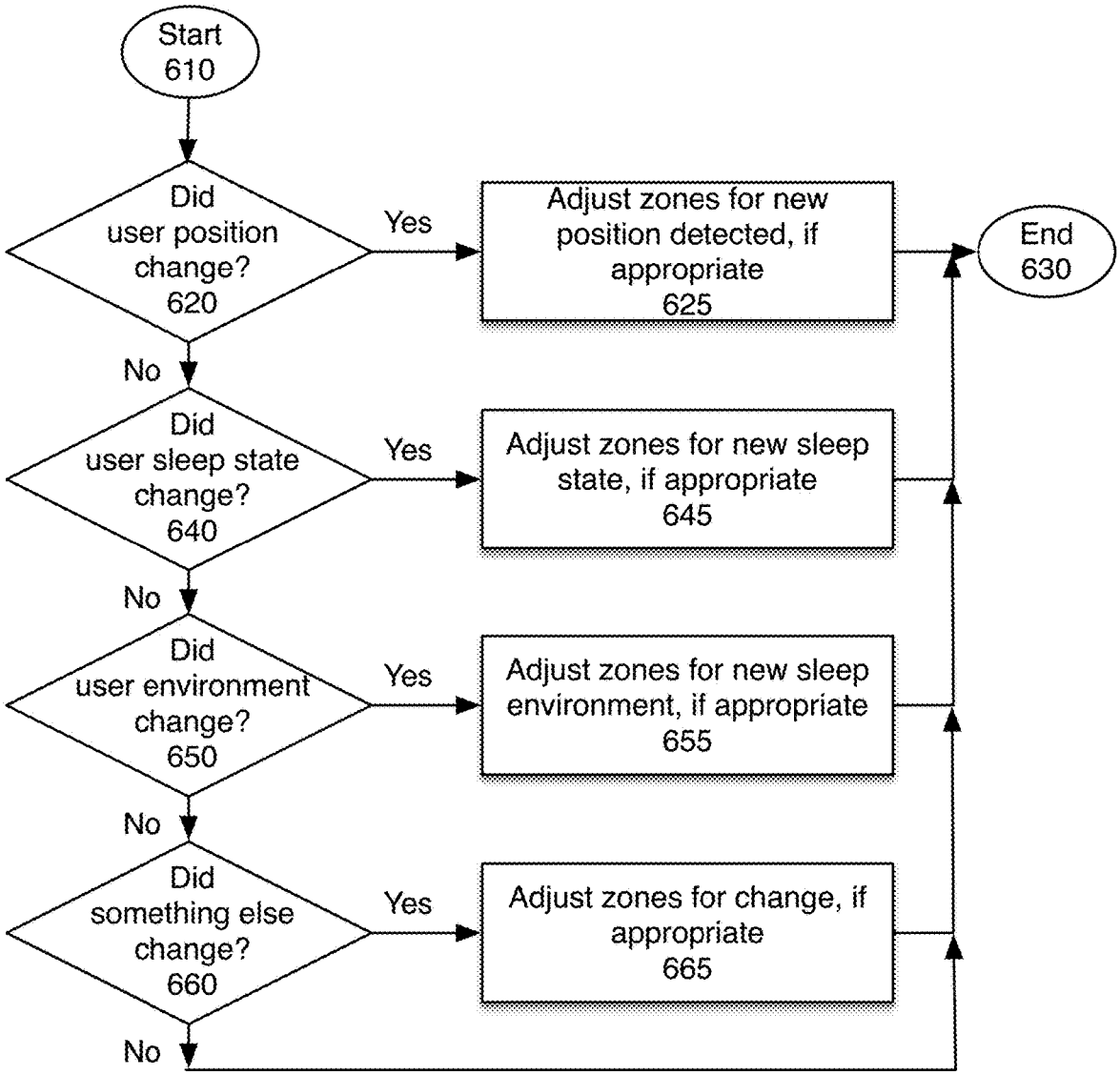
FIG. 6 is a flowchart of one embodiment of determining whether the mattress zones should be adjusted.

FIG. 6 is a flowchart of one embodiment of determining whether the mattress zones should be adjusted. The process starts at block 610. In one embodiment, this flowchart corresponds to block 545 of FIG. 5.

Returning to FIG. 6, at block 620 the process determines whether the user's position has changed. As noted above, the typical user changes sleep positions at least four time a night, and it is not uncommon to change sleep positions ten or more times in a single night, while sleeping normally. If the user position change as detected, at block 625 the bed is adjusted if appropriate. In general, most positions have a different optimal mattress pressure pattern because different pressure points are presented. The process then ends at block 630. If it was not a position change, the process continues to block 640.

At block 640, the process determines whether it was a change in the sleep state. The sleep state, in one embodiment, corresponds to the four stages of sleep. If it is a change in the sleep state, the process at block 645 adjusts the bed, if appropriate. In one embodiment, the adjustment may alter the pressure distribution, the temperature, or other aspects of the bed. The process then ends at block 630. If it was not a position change, the process continues to block 650.

At block 650, the process determines whether the user environment changed. If so, at block 655 the bed is adjusted if appropriate. The process then ends at block 630. If it was not an environment change, the process continues to block 660.

At block 660, the other change is identified. As a general rule, changes that alter the way the user is utilizing the bed are detected. For example, the change may have been that an animal jumped onto the bed, a second person is on the bed, or any other detectable change. At block 665, the bed is adjusted if appropriate. The process then ends at block 630.

Figure 7:
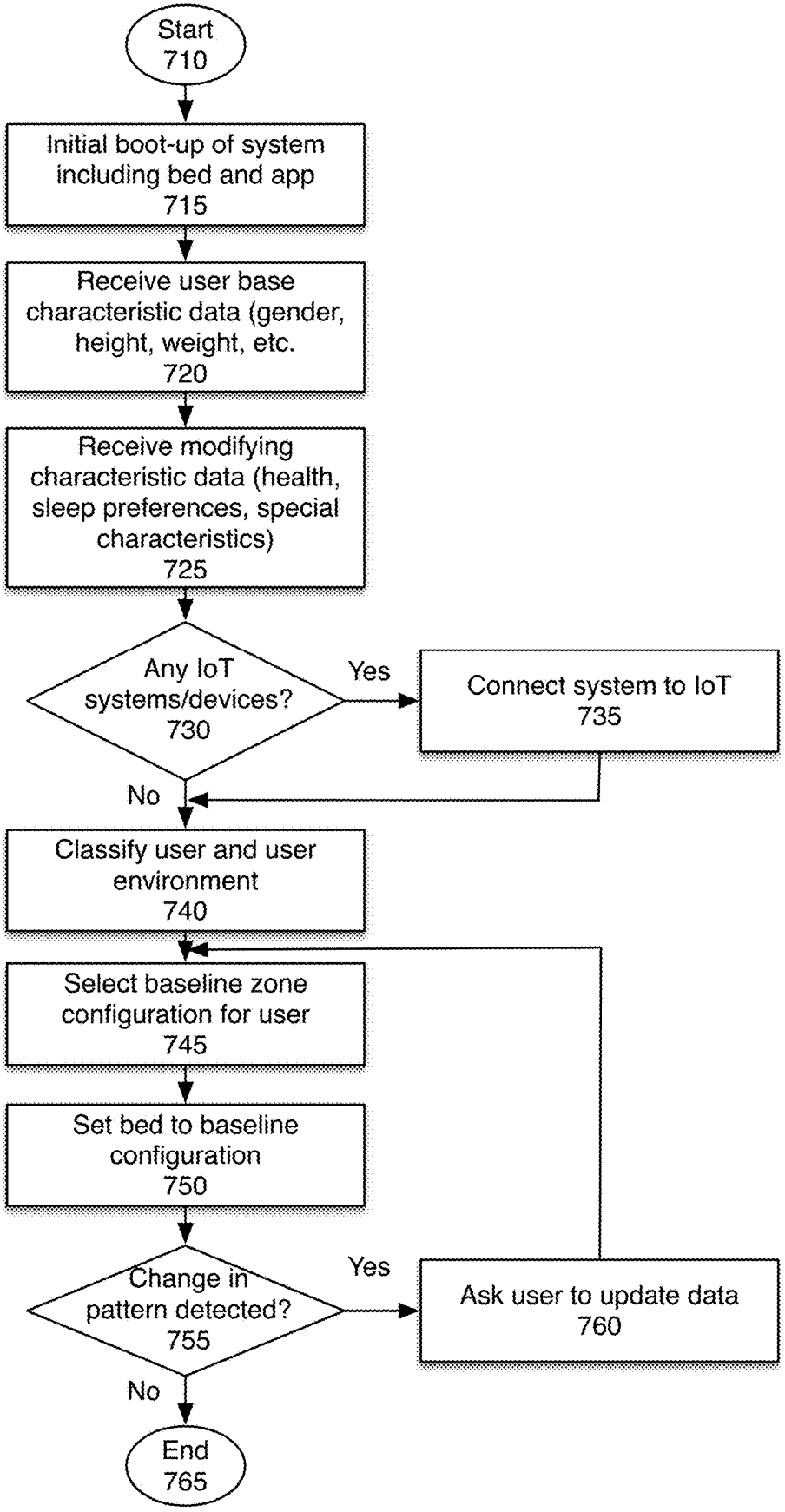
FIG. 7 is a flowchart of one embodiment of initial set-up for a user.

FIG. 7 is a flowchart of one embodiment of the set-up for a user. The process starts at block 710. In one embodiment, this process starts when a user initializes a new system. At block 715, the system is booted up, including the bed and an application. In one embodiment, the application may be a mobile application. In one embodiment, initial boot-up includes establishing a connection between the bed and the application, either directly or indirectly. In one embodiment, the bed may send its data to the remote processing analytics system, and the mobile device may receive its data from the remote processing analytics system.

At block 720, the user base characteristic data is received. The base characteristics may include height, weight, age, and gender. In one embodiment, base characteristics may also include sub-measurements, e.g. inseam/leg length, torso length, etc. These factors are used to optimize the bed for the user.

At block 725, any modifying characteristics are received. Modifying characteristics may include health status, sleep preferences, special characteristics. Modifying characteristics may be permanent characteristics or temporary characteristics. Temporary characteristics may include pregnancy, recent injury or surgery, cold/flu, etc. These types of characteristics may be used to adjust the optimal bed configuration. Permanent characteristics may include permanent conditions, such as a disability or medical condition or sleep preferences. In one embodiment, the user is encouraged to periodically update these characteristics. In one embodiment, the system may identify a new potential characteristic, based on detected data and ask the user to verify. For example, based on sleep patterns the system may identify a recent knee injury. In one embodiment, the system would request confirmation from the user, and then adjust its settings accordingly.

At block 730 the process determines whether there are any IoT systems to which the present system may link. If so, at block 735, the system is connected to the IoT devices. The process then continues to block 740.

At block 740, the user and user environment are classified. The classification is used by the recommendation engine to determine the optimal settings for the various positions. For example, a very tall skinny man would have a different configuration of pressure zones in the same sleep position as a short overweight man.

At block 745, the baseline zone configurations are selected for the user, based on the classification. The baseline zone configuration is the initial configuration from which the bed is adjusted. In one embodiment, the bed returns to the baseline configuration hen the user gets up. These baseline zone configurations may be altered over time, as the system learns the user's personal patterns and matches to more precisely to a group of users. For example, it may turn out that those tall skinny men have a different initial configuration, when they are classified as tall, skinny, asthmatic, and living in a high humidity environment. Because the system is an intelligent learning system, over time the feedback and data will be used to adjust the baseline, as well as adjust the individual users' configurations.

At block 755, the process determines whether the user's pattern has changed. Generally, most users fall asleep in one position typically, and move through a similar pattern in the night. The system tracks the user's pattern of positions over time. If a change in the pattern is detected at block 755, the process continues to block 760. At block 760 the user is asked to update their characteristic data. In one embodiment, if new information is received (e.g. a change in health condition, or other user characteristic) the process adjusts the settings at block 745. Otherwise, the process continues to 765. The process then ends at block 765.

Figure 8:
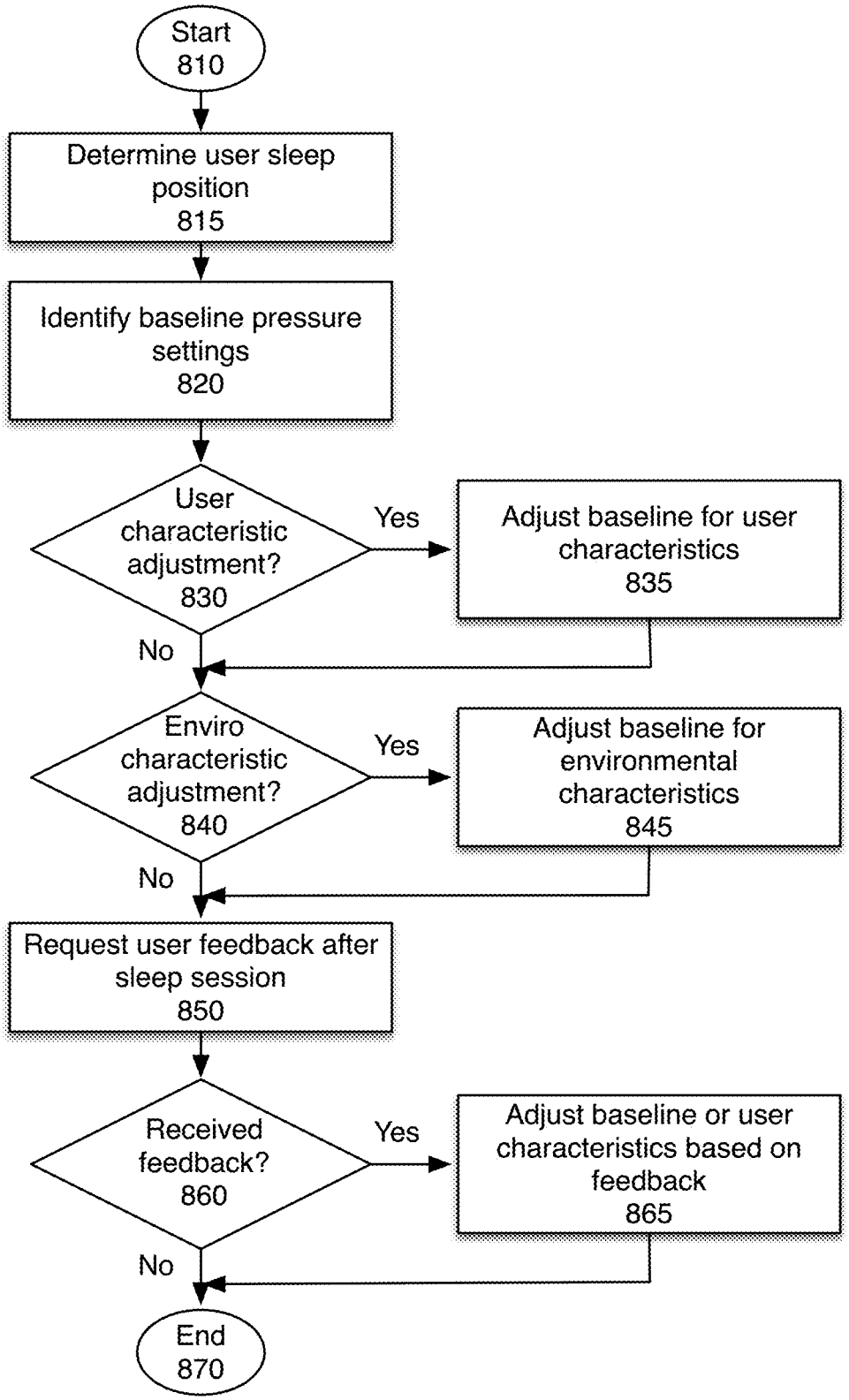
FIG. 8 is a flowchart of one embodiment of customization for a user.

FIG. 8 is a flowchart of one embodiment of customization for a user. The process starts at block 810. At block 815, the user's sleep position is determined. At block 820, the baseline pressure settings for the sleep position are identified.

At block 830, the system determines whether it needs to apply the user characteristic adjustment. If so, the baseline is adjusted for the user characteristic at block 835. In one embodiment, rather than evaluating each user characteristic individually the system uses the user classification, discussed above to determine the adjustment, if appropriate.

At block 840, the system determines whether there needs to be an environmental characteristic adjustment. If so, the baseline is adjusted for the environmental characteristic at block 845. In one embodiment, rather than evaluating each environment individually the system uses an environmental, discussed above to determine the adjustment, if appropriate.

At block 850, the system requests user feedback after a sleep session. In one embodiment, the user is encouraged to provide feedback after each sleep session. In one embodiment, the feedback is requested periodically, such as once a week. In one embodiment, feedback is requested when the data shows a change in the user's sleep patterns.

At block 860, the process determines whether feedback was received. If so, at block 865 the baseline and/or user characteristics are adjusted based on the feedback. The process then ends.

Figure 9:
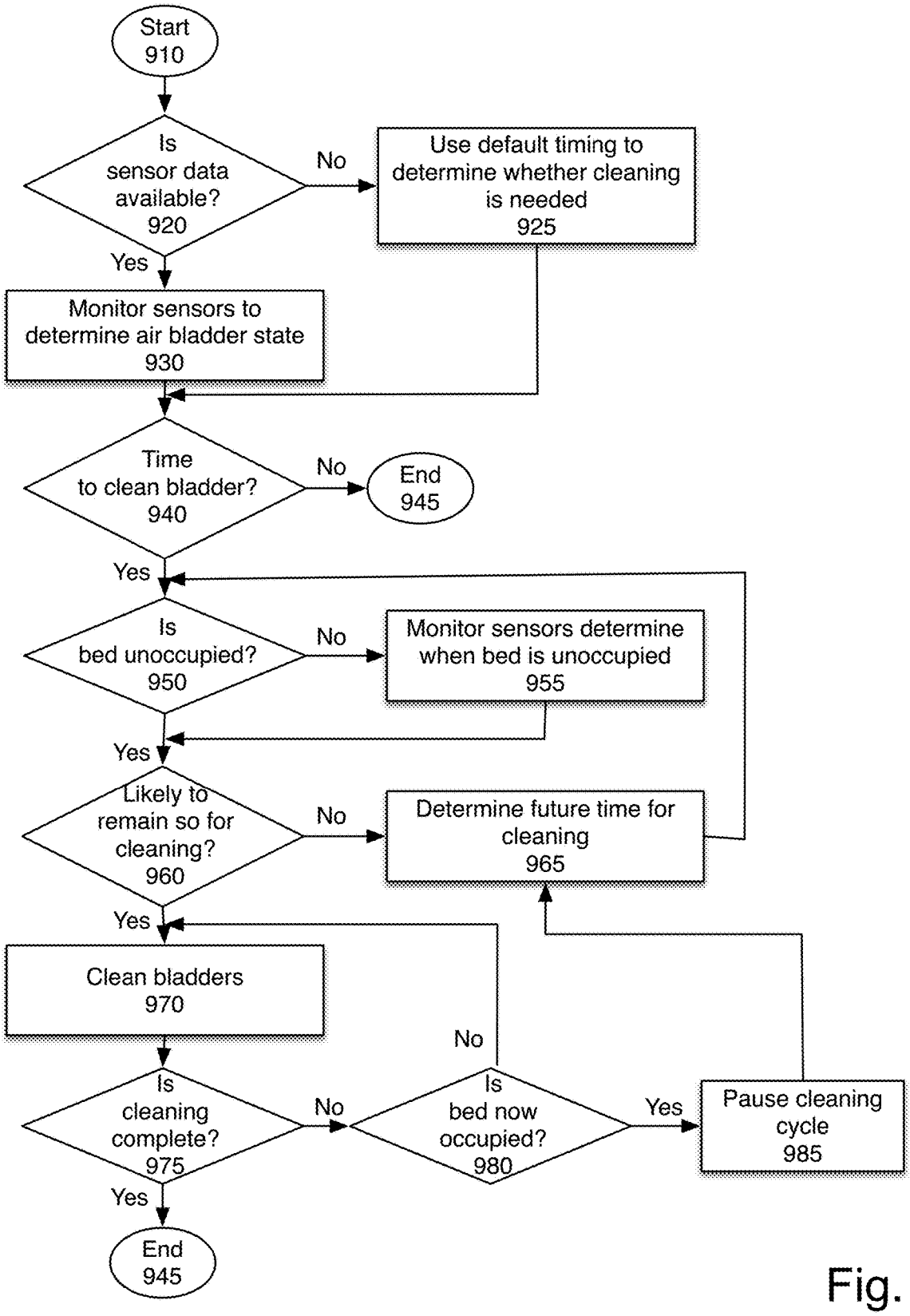
FIG. 9 is a flowchart of one embodiment of cleaning an adjustment bladder of a bed.

FIG. 9 is a flowchart of one embodiment of cleaning an adjustable bladder of a bed. The process starts at block 910. In one embodiment, the process is initiated periodically. In one embodiment, a timer is used to determine when it is time to clean the bladder. In another embodiment, sensor data is used, as will be described below. In one embodiment, a combination of sensor data and timing data may be used, where the system starts testing after a time has elapsed. In one embodiment, the system tests periodically, e.g. once per day, once per week, or in another interval.

At block 920, the process determines whether sensor data is available. Sensor data may include humidity sensors, bacterial sensors, mold sensors, or other sensors which may be used to provide data about the condition of the air bladders in a bed.

If sensor data is not available, at block 925, a timer may be used to determine whether cleaning is needed. In one embodiment, the default period between cleanings may be based on the environment. For example, in one embodiment, the default timing may be based on the user's location. For example, a location in a warm and humid location like Palm Beach, Florida may have a different and more frequent preferred cleaning schedule compared to a warm and dry location like Palm Springs, California. In one embodiment, if neither sensor data, nor location data is available, there may be a baseline cleaning schedule that is used. The process then continues to block 940.

If sensor data is available at block 920, at block 930 the sensor data is monitored and analyzed to determine the status of the bladders.

At block 940, the process determines whether it is time to clean the bladders. As noted above, in one embodiment, the determination may be based on the sensor data. In another embodiment, the determination is based on a timing data, e.g. a time since the last time the bladder was cleaned. If it is not yet time to clean the bladder, the process ends at block 945. As noted above, the air bladder state is continuously monitored in one embodiment.

If it is time to clean the bladder, the process continues to block 950 to start the cleaning process.

At block 950, the process determines whether the bed is unoccupied. In one embodiment, because the cleaning involves altering the air pressure in one or more bladders, the bladders are preferably cleaned when the bed is unoccupied. In another embodiment, this determination may be skipped and the cleaning may be initiated without such a determination.

If the bed is occupied when the cleaning is triggered, at block 955, in one embodiment, the sensors in the bed are monitored to determine when the bed becomes unoccupied. In one embodiment, the system may automatically trigger the next step when the unoccupied bed is detected, after the cleaning process is initiated at block 940.

If the bed is unoccupied, in one embodiment the process at block 960 determines whether it is likely to remain unoccupied for the length of the cleaning cycle. In one embodiment, the system uses the data about the user's past behavior to determine when the bed is likely to be occupied. For example, in one embodiment, a cleaning cycle that is two hours would not be initiated within two hours of the user's normal bedtime.

If the bed is not likely to remain unoccupied, in one embodiment, a future time for cleaning is identified, at block 965. The process then returns to block 950, at that future time, to determine whether the bed is unoccupied. In this way, the cleaning process may be delayed to minimize the impact of the cleaning on the user's sleep.

If the bed is likely to remain unoccupied, at block 970, the bladder cleaning cycle is initiated. As noted above, the bladder cleaning may use hot and/or cold air, ultraviolet, cleaning solutions, cleaning gasses, or another way of removing potential bacteria, mold, or other contaminants from the bladders within the mattress.

At block 975, the process determines whether the cleaning is complete. If so, the process ends.

If the cleaning is not yet complete, in one embodiment, at block 980 the process determines whether the bed remains unoccupied. If so, the process continues to clean the bladders, at block 970. If the bed becomes occupied, at block 985 the cleaning cycle is paused, in one embodiment. The process then continues to block 965 to continue the cleaning cycle after the bed becomes unoccupied.

In one embodiment, rather than cleaning all of the bladders in one cleaning cycle, the system may rotate through the bladders to ensure that they are cleaned over time. In one embodiment, instead of pausing a cleaning cycle if the user gets on the bed, the system finishes the current cleaning cycle, or portion of the cleaning cycle, prior to pausing the cleaning. Other ways of adjusting the cleaning cycle to minimally impact the user's experience may be used.

Of course, though the above figures are shown as flowcharts, the system may be implemented for example as an interrupt-driven system, such that the system monitors continuously and triggers a separate thread when a change is detected in the user's sleep position, environment, etc. Similarly, while the steps are illustrated in a particular order for convenience, the ordering is arbitrary to the extent that steps are not dependent on each other.

Figure 10:
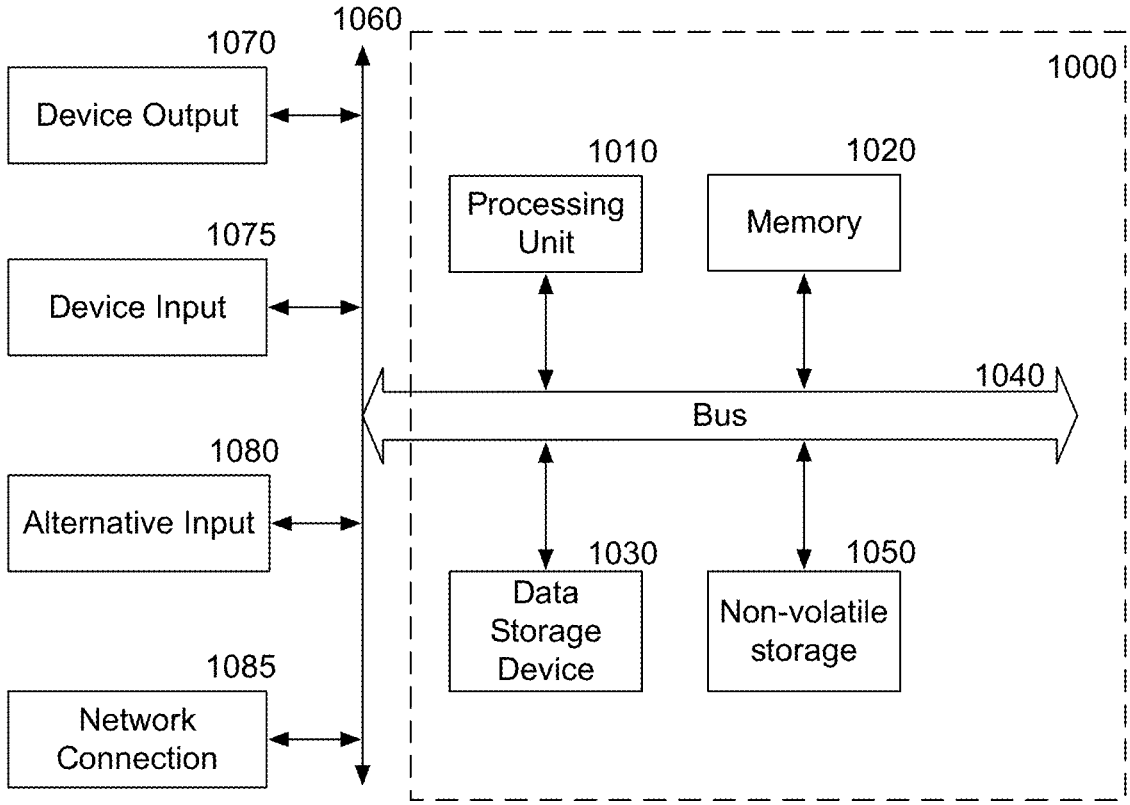
FIG. 10 is a block diagram of one embodiment of a computer system that may be used with the present invention.

FIG. 10 is a block diagram of one embodiment of a computer system that may be used with the present invention. It will be apparent to those of ordinary skill in the art, however that other alternative systems of various system architectures may also be used.

The data processing system illustrated in FIG. 10 includes a bus or other internal communication means 1040 for communicating information, and a processing unit 1010 coupled to the bus 1040 for processing information. The processing unit 1010 may be a central processing unit (CPU), a digital signal processor (DSP), or another type of processing unit 1010.

The system further includes, in one embodiment, a random access memory (RAM) or other volatile storage device 1020 (referred to as memory), coupled to bus 1040 for storing information and instructions to be executed by processor 1010. Main memory 1020 may also be used for storing temporary variables or other intermediate information during execution of instructions by processing unit 1010.

The system also comprises in one embodiment a read only memory (ROM) 1050 and/or static storage device 1050 coupled to bus 1040 for storing static information and instructions for processor 1010. In one embodiment, the system also includes a data storage device 1030 such as a magnetic disk or optical disk and its corresponding disk drive, or Flash memory or other storage which is capable of storing data when no power is supplied to the system. Data storage device 1030 in one embodiment is coupled to bus 1040 for storing information and instructions.

The system may further be coupled to an output device 1070, such as a cathode ray tube (CRT) or a liquid crystal display (LCD) coupled to bus 1040 through bus 1060 for outputting information. The output device 1070 may be a visual output device, an audio output device, and/or tactile output device (e.g. vibrations, etc.)

An input device 1075 may be coupled to the bus 1060. The input device 1075 may be an alphanumeric input device, such as a keyboard including alphanumeric and other keys, for enabling a user to communicate information and command selections to processing unit 1010. An additional user input device 1080 may further be included. One such user input device 1080 is cursor control device 1080, such as a mouse, a trackball, stylus, cursor direction keys, or touch screen, may be coupled to bus 1040 through bus 1060 for communicating direction information and command selections to processing unit 1010, and for controlling movement on display device 1070.

Another device, which may optionally be coupled to computer system 1000, is a network device 1085 for accessing other nodes of a distributed system via a network. The communication device 1085 may include any of a number of commercially available networking peripheral devices such as those used for coupling to an Ethernet, token ring, Internet, or wide area network, personal area network, wireless network or other method of accessing other devices. The communication device 1085 may further be a null-modem connection, or any other mechanism that provides connectivity between the computer system 1000 and the outside world.

Note that any or all of the components of this system illustrated in FIG. 10 and associated hardware may be used in various embodiments of the present invention.

It will be appreciated by those of ordinary skill in the art that the particular machine that embodies the present invention may be configured in various ways according to the particular implementation. The control logic or software implementing the present invention can be stored in main memory 1020, mass storage device 1030, or other storage medium locally or remotely accessible to processor 1010.

It will be apparent to those of ordinary skill in the art that the system, method, and process described herein can be implemented as software stored in main memory 1020 or read only memory 1050 and executed by processor 1010. This control logic or software may also be resident on an article of manufacture comprising a computer readable medium having computer readable program code embodied therein and being readable by the mass storage device 1030 and for causing the processor 1010 to operate in accordance with the methods and teachings herein.

The present invention may also be embodied in a handheld or portable device containing a subset of the computer hardware components described above. For example, the handheld device may be configured to contain only the bus 1040, the processor 1010, and memory 1050 and/or 1020.

The handheld device may be configured to include a set of buttons or input signaling components with which a user may select from a set of available options. These could be considered input device #1 1075 or input device #2 1080. The handheld device may also be configured to include an output device 1070 such as a liquid crystal display (LCD) or display element matrix for displaying information to a user of the handheld device. Conventional methods may be used to implement such a handheld device. The implementation of the present invention for such a device would be apparent to one of ordinary skill in the art given the disclosure of the present invention as provided herein.

The present invention may also be embodied in a special purpose appliance including a subset of the computer hardware components described above, such as a kiosk or a vehicle. For example, the appliance may include a processing unit 1010, a data storage device 1030, a bus 1040, and memory 1020, and no input/output mechanisms, or only rudimentary communications mechanisms, such as a small touch-screen that permits the user to communicate in a basic manner with the device. In general, the more special-purpose the device is, the fewer of the elements need be present for the device to function. In some devices, communications with the user may be through a touch-based screen, or similar mechanism. In one embodiment, the device may not provide any direct input/output signals but may be configured and accessed through a website or other network-based connection through network device 1085.

It will be appreciated by those of ordinary skill in the art that any configuration of the particular machine implemented as the computer system may be used according to the particular implementation. The control logic or software implementing the present invention can be stored on any machine-readable medium locally or remotely accessible to processor 1010. A machine-readable medium includes any mechanism for storing information in a form readable by a machine (e.g. a computer). For example, a machine readable medium includes read-only memory (ROM), random access memory (RAM), magnetic disk storage media, optical storage media, flash memory devices, or other storage media which may be used for temporary or permanent data storage. In one embodiment, the control logic may be implemented as transmittable data, such as electrical, optical, acoustical or other forms of propagated signals (e.g. carrier waves, infrared signals, digital signals, etc.).

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

We claim:

1. A smart sleep system comprising:

a mattress including a plurality of pressure zones, each pressure zone separately adjustable for firmness;

a sensor to sense a user's position on the mattress;

a processing system to determine pressure for each of the plurality of pressure zones based on data from the sensor;

a controller to adjust one or more of the pressure zones from a baseline configuration based on the determination;

the processing system configured to detect a change in a sleeping pattern of the user, where the sleeping pattern of the user is a pattern formed by a sequence of different sleep positions of the user, to prompt the user to identify a temporary injury or illness, and to receive the identified temporary injury or illness from the user in response to the prompt; and the controller to adjust the pressure for one or more of the plurality of pressure zones based on the identified temporary injury or illness.

2. The smart sleep system of claim 1, further comprising:

the sensor further used to monitor a user's sleep state; and the controller further configured to adjust settings for the firmness for one or more of the pressure zones based on the user's sleep state.

3. The smart sleep system of claim 2, further comprising:

the controller further configured to continuously and automatically adjusting the settings for the user, as the user's position and the user's sleep state changes.

4. The smart sleep system of claim 1, further comprising:

the processing system further configured to determine the baseline configuration for the plurality of pressure zones based on a user category, wherein the user category comprises user characteristic data entered by the user.

5. The smart sleep system of claim 4, further comprising:

the processing system further configured to adjust the baseline configuration based on one or more of: environmental conditions and user feedback.

6. The smart sleep system of claim 1, wherein each of the plurality of pressure zones corresponds to a typical pressure point on a body, and the plurality of pressure zones are uneven in size to match proportions of the body.

7. The smart sleep system of claim 1, further comprising:

a server system configured to:

collect data from a plurality of users; and determine the baseline configuration based on an analysis of the data from the plurality of users;

wherein the baseline configuration is different for users in different user categories, and the user categories are based on user characteristics.

8. The smart sleep system of claim 7, wherein the data includes sleep position data, sleep quality data, user characteristic data, and user feedback.

9. The smart sleep system of claim 1, further comprising:

a plurality of air bladders for creating the plurality of pressure zones; and a bladder cleaner to clean an air bladder, the bladder cleaner triggered by the system.

10. The smart sleep system of claim 9, wherein the bladder cleaner is triggered based on sensor data showing that an air bladder needs cleaning.

11. The smart sleep system of claim 10, further comprising:

a sensor;

the bladder cleaner configured to be triggered based on data from the sensor, the data from the sensor identifying a location of a user on or off the mattress.

12. A method to provide a smart sleeping system including a mattress with a plurality of pressure zones separately adjustable for firmness, the method comprising:

sensing a user's position on the mattress;

determining a baseline pressure for each of the plurality of pressure zones based on the sensing;

adjusting one or more of the plurality of pressure zones from a baseline configuration based on the determination;

detecting a change in a sleeping pattern of a user, where the sleeping pattern of the user is a pattern formed by a sequence of different sleep positions of the user;

prompting the user to identify a temporary injury or illness in response to the detecting;

receiving the identified temporary injury or illness from the user in response to the prompting; and adjusting the pressure for one or more of the plurality of pressure zones based on the identified temporary injury or illness.

13. The method of claim 12, further comprising:

monitoring a user's sleep state; and adjusting settings for the firmness for one or more of the pressure zones based on the user's sleep state.

14. The method of claim 13, further comprising:

continuously and automatically adjusting the settings for the user, as the user's position and the user's sleep state changes.

15. The method of claim 12, further comprising:

determining the baseline configuration for the plurality of pressure zones based on a user category, wherein the user category comprises user characteristic data entered by the user.

16. The method of claim 15, further comprising:

adjusting the baseline configuration based on one or more of: environmental conditions and user feedback.

17. The method of claim 12, wherein each of the plurality of pressure zones corresponds to a typical pressure point on a body, and the plurality of pressure zones are uneven in size to match proportions of the body.

18. The method of claim 12, further comprising:

collecting data from a plurality of users; and determining the baseline configuration based on an analysis of the data from the plurality of users;

wherein the baseline configuration is different for users in different user categories, and the user categories are based on user characteristics.

19. The method of claim 18, wherein the data includes sleep position data, sleep quality data, user characteristic data, and user feedback.

20. The method of claim 12, wherein the mattress further comprises one or more air bladders, the method further comprising:

triggering a bladder cleaner to clean an air bladder, the bladder cleaner triggered based on one or more of:

sensor data showing that the air bladder needs cleaning; and a location of a user on or off the mattress, and a duration of a cleaning.

21. A smart sleep system comprising:

a mattress including a plurality of pressure zones, each pressure zone separately adjustable;

a processing system adjusting each of the pressure zones at a baseline for a user;

one or more sensors to sense a position of the user on the mattress;

a controller to adjust one or more of the pressure zones from the baseline based on the user's position on the mattress;

the processing system configured to detect a change in a sleeping pattern of the user and prompt the user to identify a temporary injury or illness; and the controller to adjust the pressure for one or more of the plurality of pressure zones based on the identified temporary injury or illness.

* * * * *